US010260209B1

(12) United States Patent
Malkov

(10) Patent No.: US 10,260,209 B1
(45) Date of Patent: Apr. 16, 2019

(54) MOBILE ICE AND SNOW UTILIZATION DEVICE AND METHOD

(71) Applicant: Vladimir Malkov, Staten Island, NY (US)

(72) Inventor: Vladimir Malkov, Staten Island, NY (US)

( * ) Notice: Subject to any disclaimer, the term of this patent is extended or adjusted under 35 U.S.C. 154(b) by 0 days.

(21) Appl. No.: 16/199,164

(22) Filed: Nov. 24, 2018

(51) Int. Cl.
*E01H 5/10* (2006.01)
*E01H 5/04* (2006.01)

(52) U.S. Cl.
CPC ..... *E01H 5/104* (2013.01); *E01H 5/04* (2013.01); *E01H 5/108* (2013.01)

(58) Field of Classification Search
CPC ..... E01H 5/10; E01H 5/102; E01H 5/104; E01H 5/106; E01H 5/108
See application file for complete search history.

(56) References Cited

U.S. PATENT DOCUMENTS

| | | | |
|---|---|---|---|
| 971,105 | A | 9/1910 | Bausher |
| 1,453,552 | A | 5/1923 | Fuller et al. |
| 1,681,104 | A | 8/1928 | Earnhardt |
| 2,820,450 | A | 1/1958 | Zimmerman |
| 2,877,762 | A | 3/1959 | Flynn |
| 3,171,405 | A | 3/1965 | Miller |
| 3,304,632 | A | 2/1967 | Kolar |
| 3,353,286 | A | 11/1967 | Marks |
| 3,404,470 | A | 10/1968 | Raiti |
| 3,456,368 | A | 7/1969 | Jackques |
| 3,471,681 | A | 10/1969 | Miller |
| 3,484,961 | A | 12/1969 | Coslowsky |
| 3,619,918 | A | 11/1971 | Morin |
| 3,803,732 | A | 4/1974 | Moreno |
| 3,964,183 | A | 6/1976 | Mouat |
| 4,071,966 | A | 2/1978 | Cohen |
| 4,186,967 | A | 2/1980 | Kuhmonen |
| 4,226,034 | A | 10/1980 | Benjamin et al. |
| 5,642,673 | A | 7/1997 | Lucky |
| 5,791,335 | A | 8/1998 | Luciani |
| 5,948,299 | A | 9/1999 | Scalia |
| 6,360,738 | B1 | 3/2002 | Brooks |
| 6,675,506 | B2 | 1/2004 | Pitts |
| 6,736,129 | B1 | 5/2004 | Smith |
| 7,231,140 | B2 | 6/2007 | Dolton |
| 7,571,557 | B2 | 8/2009 | Charbonneau |

(Continued)

*Primary Examiner* — Jamie L McGowan
(74) *Attorney, Agent, or Firm* — Alexey Bakman, Esq.

(57) ABSTRACT

A device for ice and snow utilization comprises a mobile platform with adjustably-expandable melting section. The melting section comprises a clean-melting enclosure and a dirt-melting gap. The clean-melting enclosure comprises a plurality of telescopically-movable sections. The dirt-melting gap is positioned below the clean-melting enclosure and is separated from the clean-melting enclosure by the floor. The melting section comprises a plurality of melting nozzles, configured to release a pressurized stream of melting liquid. Some of the melting nozzles are positioned in clean-melting enclosure and some are positioned below the floor, in the dirt-melting gap. At least some of the melting nozzles are movably and adjustably positioned by being connected to at least one of telescopically movable sections. The device further comprises a plurality of pipelines, valves, pumps, at least one heating element, a vacuum collector tank, and melting-liquid unloading tanks, configured for sequential unloading.

20 Claims, 5 Drawing Sheets

(56) References Cited

U.S. PATENT DOCUMENTS

| | | | |
|---|---|---|---|
| 7,958,656 | B2 | 6/2011 | Soderberg et al. |
| 8,640,687 | B2 | 2/2014 | Tucker |
| 9,290,899 | B2 | 3/2016 | Fonesca |
| 9,689,127 | B2 | 6/2017 | Amani |
| 9,695,562 | B2 | 7/2017 | Lukaj |
| 9,945,086 | B2 | 4/2018 | Sanchez |
| 10,000,901 | B1 | 6/2018 | Gallo |
| 2004/0074114 | A1 | 4/2004 | Rogers |
| 2009/0044934 | A1 | 2/2009 | Malkov |
| 2009/0217554 | A1 | 9/2009 | Tucker |
| 2012/0258411 | A1 | 3/2012 | Anderson |
| 2016/0053452 | A1 | 2/2016 | Treglown |
| 2017/0175351 | A1 | 6/2017 | Mast et al. |

MOBILE ICE AND SNOW UTILIZATION DEVICE AND METHOD

FIELD OF THE INVENTION

The field of the present invention is ice and snow melting and utilization devices, and particularly, a mobile ice and snow utilization device with a plurality of multi-level height-adjustable melting nozzles and a plurality of melting-fluid reserve tanks.

BACKGROUND OF THE INVENTION

Snowstorms bring major dangers, expenditures and inconveniences. From drivers and home owners to large-scale municipal services, all experience the burdens associated with ice and snow accumulation. From hardships of shoveling snow and increased accident rates, to shutdowns of entire cities, winter precipitation exacts a heavy toll on society. Yet, current methods of dealing with this major menace remain mostly primitive and leave much room for improvement.

When temperature is close to melting point and accumulations of snow are insignificant, salt is often used to melt the snow. Salted snow melts into a salty solution on roads and sidewalks. The solution is usually not gathered up after the treatment. Instead, it stays on the road surface or absorbs into the nearby soils, causing a number of adverse environmental effects, including the change in soil pH and contamination of ground waters. Salt on the road accelerates rust and causes other damage to vehicles. Upon drying, salty solution turns into a fine dust, causing allergies and other health-related issues in nearby communities.

The extent of environmental effect of highway salting can not be underestimated. Quantities of salt poured out across the nation are staggering. Some 10 million tons of salt per year are dumped onto the highways. Some states, such as Massachusetts annually use up to 19.4 tons of salt per lane on each mile of its state highways. All of this salt is left to interact with the environment.

If the temperature is low or precipitation is heavy, the use of salt may not even be sufficient to melt the accumulations of snow. In such situations, the use of salt is a waste of resources and contamination of the environment without a tangible positive effect. Furthermore, treatment of snow with salt at lower temperatures actually worsens snow's characteristics, creating an unpassable mushy mass, instead of a dense level surface.

Moreover, treatment of road surfaces with salt and/or sand can only be executed on short stretches of the roadway. Each truck, loaded with salt and/or sand can cover a limited distance of the roadway before it must return to the salt/sand storage depot for reloading. The return trips and reloading greatly reduce the time that this special equipment is actually used to treat the roads.

It is also worth noting that salting and sanding of the road surfaces introduces physical particles, capable of causing physical damage to vehicles and bystanders. Sand often contains larger particles and rocky bits. Similarly, salt is often clumped into rocks. These hard particles can be turned into dangerous missiles by spreading equipment and passing cars. Each winter, numerous instances of windshield damage and injury are reported due to the substances deposited onto the highways.

Physical removal of snow commonly involves various types of plows and screw conveyor systems. These machines often cause mechanical scraping of the road surface, leading to damage and necessity of expensive repairs. Furthermore, these devices are limited in efficiency by the height of snow accumulation. The height (and/or width) of the plow or the mouth of the screw conveyor is set and can not be fully adjusted to address the varying height of the snow accumulation. For example, if the accumulations of snow are much greater than the height of the collection device (such as a plow), then the collection device must be raised in order to interact with the upper layer of the accumulation. If it is raised, then the efficiency of cleaning drops, as the lower layer of accumulation does not get gathered/moved at the same time. Instead, this layer gets compacted by the vehicle passing behind the plow/conveyor, making the snow harder to remove and slower to melt. If the plow is lowered, so that the snow overflows the top edge, then the top layer does not get moved. Not only does this top layer of snow stay on the road, but it gets in front of the collecting vehicle, lowering its efficiency and/or preventing movement.

Collection of the snow, using a traditional plow or screw conveyor also frequently leaves behind a layer of ice, bonded to the road cover. Thus, often the removal of top layers of snow leads to exposure of the underlying black ice. This results in increased incidence or car accidents and pedestrian slips and falls.

Furthermore, snow, removed in the traditional mechanical way, is often not disposed of. Rather, it is commonly simply shifted to the sides of the street, reducing the width of lanes, and blocking parked vehicles, sidewalks and pedestrian crossings. Car owners are often forced to throw snow back onto the road in an effort to free their cars, often reversing the cleaning efforts.

Rarely, the snow is gathered and loaded onto the trucks for remote disposal or melting. Gathering and transporting the snow, even from a limited area, requires tremendous transportation capabilities and costs. Once the snow is transported to the final destination, it's utilization poses additional issues. Keeping up with melting of great quantities of transported compacted snow, as truckloads arrive, is often unfeasible. When snow is dumped into giant piles, such piles take many months to fully melt, taking up valuable space and causing build-ups of melted water. When it is dumped into natural bodies of water, together with salt and road waste, environmental damage occurs.

Some prior art devices attempt to melt the gathered ice and snow within the device. However, melting of the snow is commonly done after it is mechanically collected and loaded into the device. This method does not avoid the inefficiencies of mechanical collection and scraping/damage to the road cover, as described above. Furthermore, collected snow usually includes the dirt and debris from the lower layers of snow, closest to the road surface. The melt, resulting from such a collection, is a dirty slush that can not be efficiently reused and must be dumped, resulting in inefficiency energy use and pollution.

In light of the problems associated with traditional methods of snow and ice removal, there is a long-standing and unsatisfied need in the art for a device and method that would address these shortcomings. The new device and method must be capable of not just shifting the accumulations, but of actually melting and removing ice and snow from surfaces. It must do so evenly, quickly and efficiently, with minimal energy expenditures. Where possible, the device must recycle the resources and conserve heat. It must be capable of leaving surfaces free of ice and snow without leaving behind any potentially-dangerous rocky bits, salt or chemical residue. The new device should be capable of removing not only the upper layers of snowy accumulations, but also the underlying layer of ice, frozen to the surface. Such device and method must also avoid scratching, chipping and otherwise damaging the road surface, as present methods do. Furthermore, the height/width of the snow-melting section of the new device must be adjustable in order to efficiently accommodate various levels of ice/snow accumulations. The device must also be capable of operating continuously for extended periods of time without the need to reload/resupply its chambers. The present invention achieves all of these objectives and provides numerous additional benefits.

SUMMARY OF THE PRESENT INVENTION

The present invention is defined by the following claims and nothing in this section should be taken as a limitation on those claims.

The Mobile Ice and Snow Utilization Device of the present invention comprises a mobile platform that has a forwardly-attached, adjustably-expandable melting section. The melting section is attached to the front side of the platform and comprises a clean-melting enclosure and a dirt-melting gap. The presence of the clean-melting enclosure and a dirt-melting gap allow for unique dual-level processing of snow accumulations and for recycling of the melt.

The clean-melting enclosure comprises an open front end, a back wall, a plurality of side walls, a floor and a roof. It also comprises a plurality of telescopically-movable sections. At least some of the telescopically-movable sections are slidably overimposed over at least one similar adjacent section, thus creating a telescopically-expandable vertical surface.

The dirt-melting gap is positioned below the clean-melting enclosure and is separated from the clean-melting enclosure by the floor.

The melting section further comprises a plurality of melting nozzles. The melting nozzles are intended for and configured to release a pressurized stream of melting liquid. At least some melting nozzles are positioned in the open front end of the clean-melting enclosure and at least one of the plurality of melting nozzles is positioned below the floor, in the dirt-melting gap.

At least some of the melting nozzles are movably and adjustably positioned in the clean-melting section by being connected to telescopically movable sections, and thus capable of movement by moving along with the movable sections.

The device further comprises a control panel, a plurality of pipelines, a plurality of pumps, at least one heating element, a vacuum collector tank, and a plurality of melting-liquid unloading tanks. These unloading tanks are configured for sequential unloading of the melting liquid. The device has a plurality of valves, among which is at least one distribution valve.

The method of using the device for melting of ice and snow, as well as the method of using the device to obtain clean water are also described and claimed.

DETAILED DESCRIPTION OF THE PREFERRED EMBODIMENT

Figure 1:
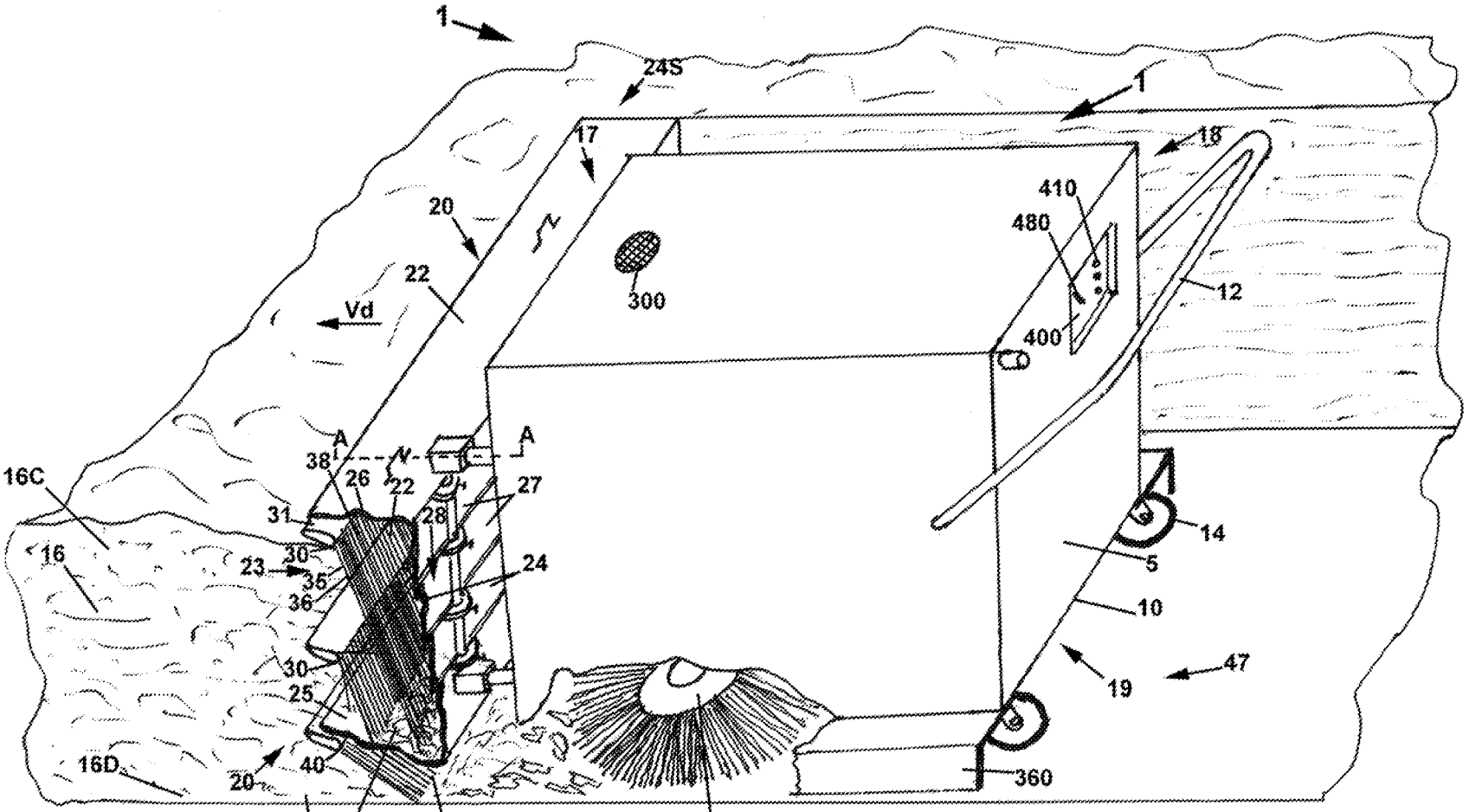
FIG. 1 is a perspective view of one of a preferred embodiment of the Mobile Ice and Snow Utilization Device of the present invention.

The method and apparatus of the present invention will now be illustrated by reference to the accompanying drawings. Preferred embodiments of the mobile ice and snow utilization device and method of the present invention have been assigned reference numeral 1. The mobile ice and snow utilization device and method are also referred to as Device 1 or Method 1 in the present description. Other elements have been assigned the reference numerals referred to below.

Preferred embodiments of the present invention, are intended for melting and elimination of ice and snow over flat, substantially level surfaces, such as roads, driveways, sidewalks, parking lots, rooftops, etc. Device 1 is capable of simultaneously melting the accumulations and removing most of the resulting melt from the surface. The device features a unique height-adjustable multi-level melting section that allows for versatility and efficiency in melting varying levels of snow accumulation. Uniquely designed and aimed nozzles within the melting section produce a liquid melting plane that melts ice and snow upon contact. Unique structure of the device 1 allows for melt to be separated into the clean and dirty melt, with clean melt being recirculated within the device to improve heat efficiency and produce uninterrupted functionality. The separation of clean and dirty melt also allows for use of the device to obtain clean, usable liquid water from snow accumulations. Uninterrupted functionality and efficiency of the device is further ensured by the unique construction, featuring a plurality of alternatively and sequentially-unloading discharging tanks.

The device 1 comprises a mobile platform 10 (platform 10). The platform 10 comprises a forwardly-attached adjustably-expandable melting section 20. One of the preferred embodiments of the platform 10 is illustrated on FIG. 1. In this embodiment, the mobile platform 10 is in the form of a manually-actuated push-cart-type vehicle with a push-handle 12 and a plurality of wheels 14. Such a platform is intended to be manually moved by user along a road surface 47, as the device 10 melts the layers of ice and snow accumulations 16. In other preferred embodiments, the mobile platform 10 may be self-propelled (comprising its own means of propulsion) or may be attached to and pushed forward by another vehicle.

Platform 10 comprises the front side 17 of the platform 10, the rear side 18 of the platform 10, and the bottom side 19 of the platform 10. The forwardly-attached adjustably-expandable melting section 20 (melting section 20) is attached to the front side 17 of the platform 10. Hence, the designation of "forwardly" attached. This "forwardly attached" feature of the present invention is in contrast to devices of the prior art, where the snow is first mechanically collected by a plow or a screw conveyor, and then transported to a rearward section for melting. Device 1 of the present invention processes/melts snow at the front of the device, without the need to mechanically collect and forward unmelted snow rearwards.

The melting section 20 is uniquely "adjustably-expandable". This term refers to the structural feature, allowing for the ability of physical expansion or contraction of melting section 20, in order to accommodate varying heights of snow accumulations.

In preferred embodiments, the melting section 20 comprises a box-like snow-melting enclosure 22 (clean-melting enclosure 22, melting enclosure 22) with open front end 23. (The shape of the enclosure 22 may vary in alternative embodiments.) The melting enclosure 22 is also referred to as clean-melting enclosure 22, since most of the snow that enters and melts in this enclosure is relatively clean, free of dirt and debris contamination, and may, thus be recycled by the device 1. This element is contrasted by the dirt-melting gap 45, as described below.

The clean-melting enclosure 22 comprises a back wall 24, a plurality of side walls 24S, a floor 25, a roof 26. (It should be noted that FIG. 1 illustrates an embodiment, where one of the side walls 24S, is removed on the side facing the viewer for purposes of showing the internals of the clean-melting enclosure 22). The melting section 20 further comprises a plurality of telescopically-movable sections 27 (movable sections 27). The backs of these movable sections 27 at least partially make up the back wall 24, and the sides of these movable sections 27 at least partially make up the side walls 24S. The presence of telescopically-movable sections 27 provides for unique expandability and contractibility of the melting section 20 to accommodate various heights of snow accumulations.

At least some movable sections 27 are slidably overimposed (i.e. partially overlapping) over at least one adjacent movable section 27. A plurality of movable sections 27, slidably overlapping each other, create a telescopically-expandable vertical surface 28. In preferred embodiments, movable sections 27 are lockable in a variety of superimposed positions. In the preferred embodiments, movable sections 27 are held in these positions through the force of friction. However, in other embodiments, the movable sections may be secured in relation to one another via the use of notches or various other locking mechanisms.

In the preferred embodiments, each of the plurality of telescopically-movable sections 27 is comprised of a section/portion of a back wall 24, integrally-connected with adjacent sections/portions of side walls 24S, positioned on the same height as the section of a back wall 24. Essentially, a preferred telescopically-movable section 27 is a single-piece U-shaped section, where the back is straight and longer than the two sides. Integrally-connected telescopically-movable sections 27 are beneficial in that they are likely to provide a better seal against inflow of cold air into, and splattering of liquids from, the clean-melting enclosure 22. They may also provide better control for telescopic extension. However, it is foreseeable that embodiments of the present invention may be devised, where sections of back wall 24 are not integrally-connected with adjacent sections of side walls 24S.

Figure 2:
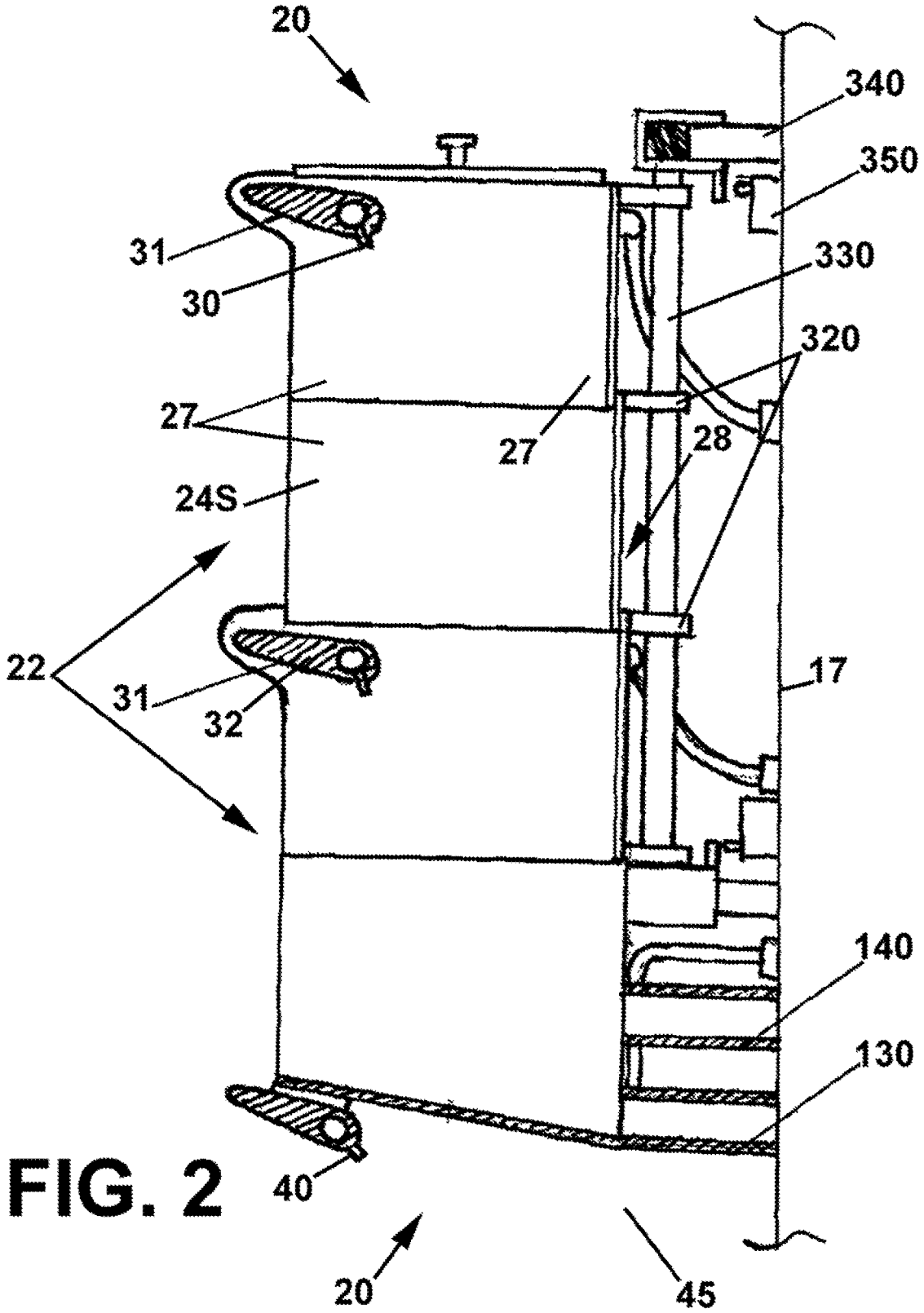
FIG. 2 is a cross-sectional view of the melting section of the preferred embodiment of the present invention, taken on line A-A of the device of FIG. 1.

In the preferred embodiment of FIG. 1 and FIG. 2, at least some (and preferably all) movable sections 27 comprise eyelets 320. Said eyelets 320 extend from the back of the movable sections 27 rearwards, away from the back wall 24 and towards the mobile platform 10. The device 1 comprises at least one (and preferably two) guides 330, running (i.e. passing) through at least some of the eyelets 320, thus guiding and supporting the movable sections 27. In the embodiment, shown in FIG. 2, each of the guides 330 is connected to the mobile platform 10 via (at least one, but preferably four) shock absorber 340, which is in turn attached to the front side 17 of the mobile platform 10. Compressibility of the shock absorber 340 is limited by the limiter 350. Once the melting enclosure 22 encounters an obstacle in its forward movement, shock absorber 340 travels backwards, eventually encountering and triggering the limiter 350. The limiter 350 halts the rearward movement of the shock abosorber 340 and, preferably, shuts off the device 1. Shock absorbers 340 help protect the melting section 20 and a variety of tubes and cables that may be running between the melting section 20 and the movable platform 10. It should also be noted that in preferred embodiments, any tubes and cables positioned in this area are preferably made of flexible material to prevent breakage.

This slidability of movable sections 27 makes the back wall 24, side walls 24S, and the entire box-like melting enclosure 22 of the preferred embodiments telescopically expandable. This allows the user to adjust the height of the melting enclosure 22 to adapt the device 1 for varying accumulations of ice and snow 16. FIG. 1 illustrates a functional situation where device 1 is moving through and melting significant accumulations of ice and snow 16. The roof 26 is raised above the height of the surface of snow, so that the entire layer could be melted in one pass of the device 1. If snow accumulations were lower, a user would be able to push down from above on the roof 26, so that movable sections 27 would telescopically slide onto each other, lowering the roof and reducing the height (and therefore the volume) of the melting enclosure 22. The reduced volume would allow for faster and/or more efficient melting of lower snow accumulations.

The melting of the snow is effectuated by a plurality of melting nozzles 30 (nozzles 30). Each of the nozzles 30 is configured to release a pressurized stream of melting liquid 35 (liquid 35), which melts ice and snow upon contact. In the preferred embodiments, illustrated in FIGS. 1 and 2, nozzles 30 are embodied inside a plurality of elongated horizontally-positioned nozzle-tubes 31, that run parallel to each other and to the floor 25 of the melting enclosure. The nozzle tubes 31 are preferably positioned towards the front of the melting section 20 on several height levels. Preferably, nozzle tubes 31 have a horizontally-elongated, drop-shaped cross-section 32 with elongated front (see FIG. 2). Such shape is beneficial for maintaining heat energy and decreased resistance, when digging into the snow as the device is moving forward into the accumulations. In the preferred embodiments, the elongated front of the nozzle tubes 31 is preferably of solid, massive construction. In most cases, this part of the device 1 will be the first to push or "dig" into the snow accumulations and must thus be solidly constructed of strong materials (such as bronze, steel, etc.) to withstand such impacts.

The nozzle tubes 31 are preferably positioned in several vertical levels. The number of nozzle tubes 31 (an accordingly the number of levels they form) in the preferred embodiments varies. For example, the preferred embodiments shown in FIGS. 1 and 2 comprise three such tubes. The preferred embodiment of FIG. 3 comprises 4 nozzle tubes 31. Other embodiments may comprise other numbers of nozzle tubes 31 and varying numbers of nozzles 30, depending on the size, capacity, pumping and heating power, etc., of a particular embodiment.

In the preferred variants, at least some, and preferably most of the melting nozzles 30, are positioned (within nozzle tubes 31) toward the front of the melting section, in the open front end 23. In these variants, the nozzles 30 are aimed substantially downwards. That is, they are aimed down, but at a slight angle toward the back wall 24. Pressurized stream of melting liquid 35 is released by the nozzles 30 downward (with a slant toward the back wall), in the form of a thermo-liquid layer 38. This thermo-liquid layer 38 is essentially a wall of (preferably fast-moving, hot) melting liquid 35. The thermo-liquid layer 38 comprises a thermo-liquid surface 36, which is the outward-facing (i.e. snow-facing) surface of the thermo-liquid layer 38. In the preferred embodiments, thermo-liquid-surface 36 comes in contact with and melts vertical layers of ice and snow, via its thermal and mechanical energy.

Streams of multiple nozzles 30 may combine to produce a thermo-liquid surface 36 (as shown in preferred embodiments). Alternatively, in some variants, a single nozzle 30 may release melting liquid 35 in the form of a thermo-liquid layer 38 with a thermo-liquid surface 36. In these variants, such a nozzle 30 may have an elongated slit-like opening, the opening horizontally extending in the direction from one side wall 24S to the opposing side wall 24S. The preferred embodiments may employ the thermo-liquid surface 36 with thickness of approximately 1/32", although this thickness is preferably adjustable and will vary in other embodiments, depending on size and power of the device 1, environmental conditions and other variables. The device 1 preferably comprises thermo-layer controls for adjusting characteristics of the thermos-liquid layer 38.

It should be noted that in some embodiments, comprising the nozzle tubes 31, there may be more than one nozzle tube 31 on each vertical level (i.e. on each level associated with a particular movable section 27). For example, on the same vertical level (on the same height) there may be a tube positioned toward the front of the melting section, one further back, and one behind it, even closer to the back wall 24. In the device of such an example, there may be several nozzle tubes 31, associated with and moving along with each movable section 27. Such set up, with several nozzle tubes on a single vertical level may be particularly advantageous in larger variants of the device 10. Likewise, in the embodiments where nozzles 30 are not contained in nozzle tubes 31, there may be several layers/lines of nozzles 30, extending from the front of the melting section towards the back wall 24, such several layers associated with each movable section 27.

In such embodiments (comprising several layers of nozzles 30 or nozzle tubes 31 on each vertical level, extending from front to back and associated with a particular movable section 27), each layer of nozzles 30 or nozzle tubes 31, may be capable of producing its own thermo-liquid layer 38. Thus, in these embodiments, there may be several distinct thermo-liquid layers 38, on the level of each movable section 27. As movable sections 27 are positioned on multiple levels, such an embodiment would have several vertical levels of movable sections 27, with several thermo-liquid layers 38 associated with each level of movable sections 27. As such an embodiment is moved forward into the snow accumulations, whatever does not get melted by the first thermo-liquid layer 38 that is positioned toward the open front end 23, gets exposed to the thermo-liquid layer 38 behind it, positioned further toward the back wall 24, then exposed to the one behind it, etc.

The melting section 20 further comprises a dirt-melting gap 45 (Also referred to as gap 45 and ice-melting gap 45). The dirt-melting gap is positioned below the snow-melting enclosure and is separated from the snow-melting enclosure by the floor 25. The floor 25, defines the upper limit (i.e. ceiling) of the dirt-melting gap 45. The lower limit of the dirt-melting gap 45 is defined by the road surface 47 (the term "road surface" refers to any surface over which device 1 is positioned for melting, be it a road surface, a parking lot, a roof of a building, etc.). In the preferred embodiments, the distance between the lower and upper limit of the dirt-melting gap 45 is approximately 2", although this may vary in other embodiments, depending on the size and power of the device 1.

Dirt-melting gap 45 processes ice and snow that accumulates directly on (or is frozen directly to) the road surface 47. The term "dirt-melting" refers to the fact that in contrast to the clean-melting enclosure 22, ice and snow that enters this section, is likely to contain dirt and debris, commonly found on road surfaces. Contaminated melt produced in this section cannot be efficiently recirculated. The presence of two separate melting sections (clean melting-enclosure 22 and Dirt-melting gap 45), allows device 1 to uniquely separate ice and snow accumulations into the distinct clean and dirty melt streams. The clean melt stream is then recycled to greatly conserve energy, the reserves of melting fluid 35 and to allow for continuous uninterrupted functionality of the device 1.

At least one of the plurality of melting nozzles 30 is positioned (below the floor 25), in the dirt-melting gap 45. Preferably, the type of nozzle 30, located in the dirt-melting gap 45 is an ice-melting nozzle 40. In some embodiments the ice-melting nozzle 40 may be the same or similar to other melting nozzles 30. In the preferred embodiment, the ice-melting nozzle 40 differs from other melting nozzles 30 in that it is pointed downward at a sharper angle than other melting nozzles 30 (pointing into the dirt-melting gap). One such ice-melting nozzle 40 is illustrated on FIG. 2. The sharper angle under which thermo-liquid surface 36 is released from the ice-melting nozzle 40 helps the liquid to get under ice layer, thus breaking connection between the ice and the road surface 47.

In the preferred embodiments, the floor 25 slants downward, as it extends in the general direction from the open front end 23 toward the back wall 24. This slant allows the "clean" mix of melted snow and of used melting liquid 35 to flow down and collect in the area where the floor 25 connects to the back wall 24. From there, the clean melt can be pumped back into the system (via clean collection tube 130) and recirculated.

It is foreseeable that in some embodiments of the device 1, the melting section 20 may be rotatably attached to the melting platform 10, the attachment configured for vertical rotation of at least part of the melting section 20. In these embodiments, the entire melting section 20 (or just the clean-melting enclosure 22 in other embodiments) is preferably capable of being rotated 90 degrees vertically. This feature may be useful if snow accumulations are extremely high, higher than the roof 26, raised to the maximum upward position. In this situation, the user may turn the melting section sideways, so that its longer sides, the roof and the floor are vertically-positioned, thus allowing for tackling higher accumulations.

Figure 3:
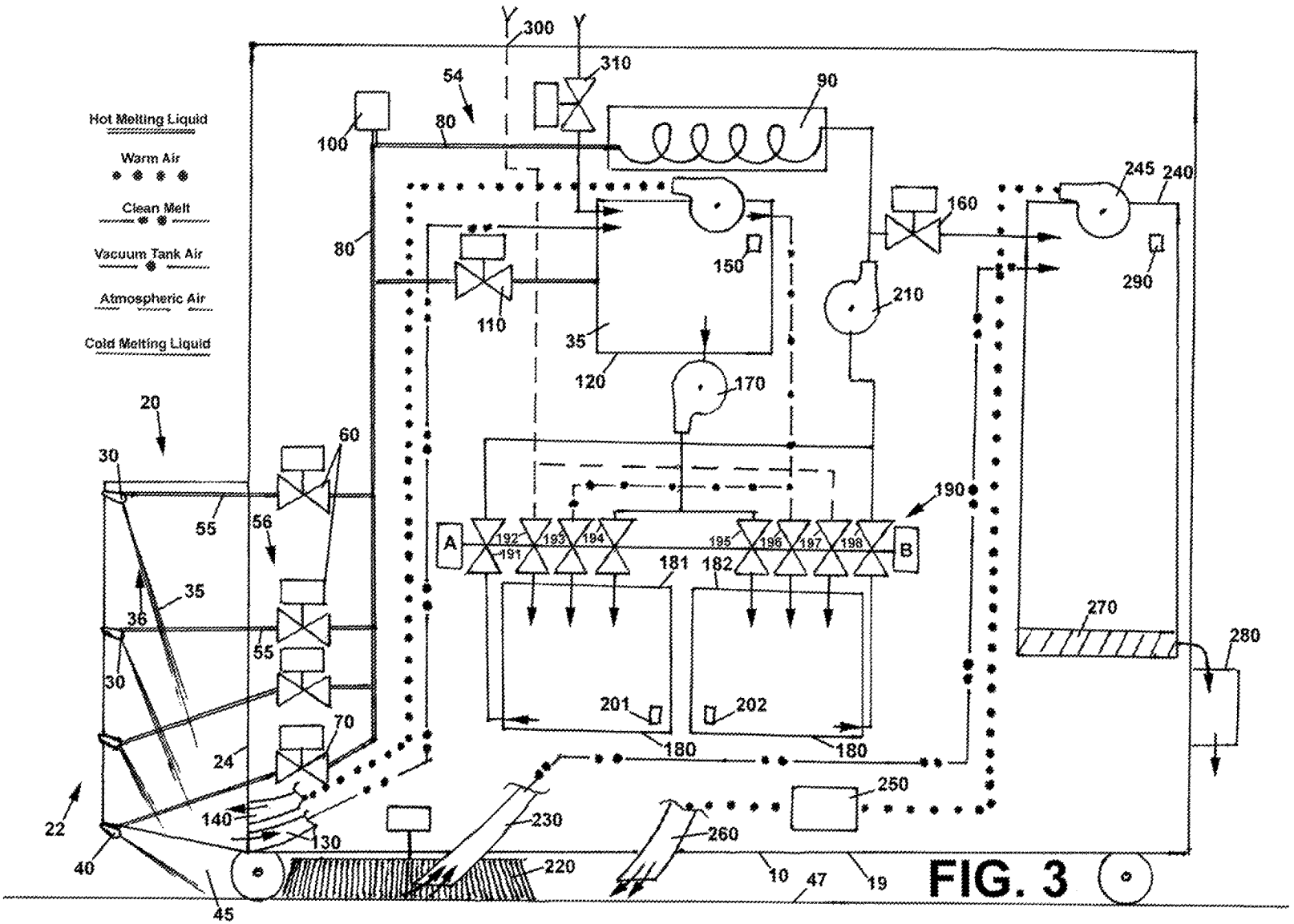
FIG. 3 is a schematic view of one of the preferred embodiments of the present invention.
Figure 4:
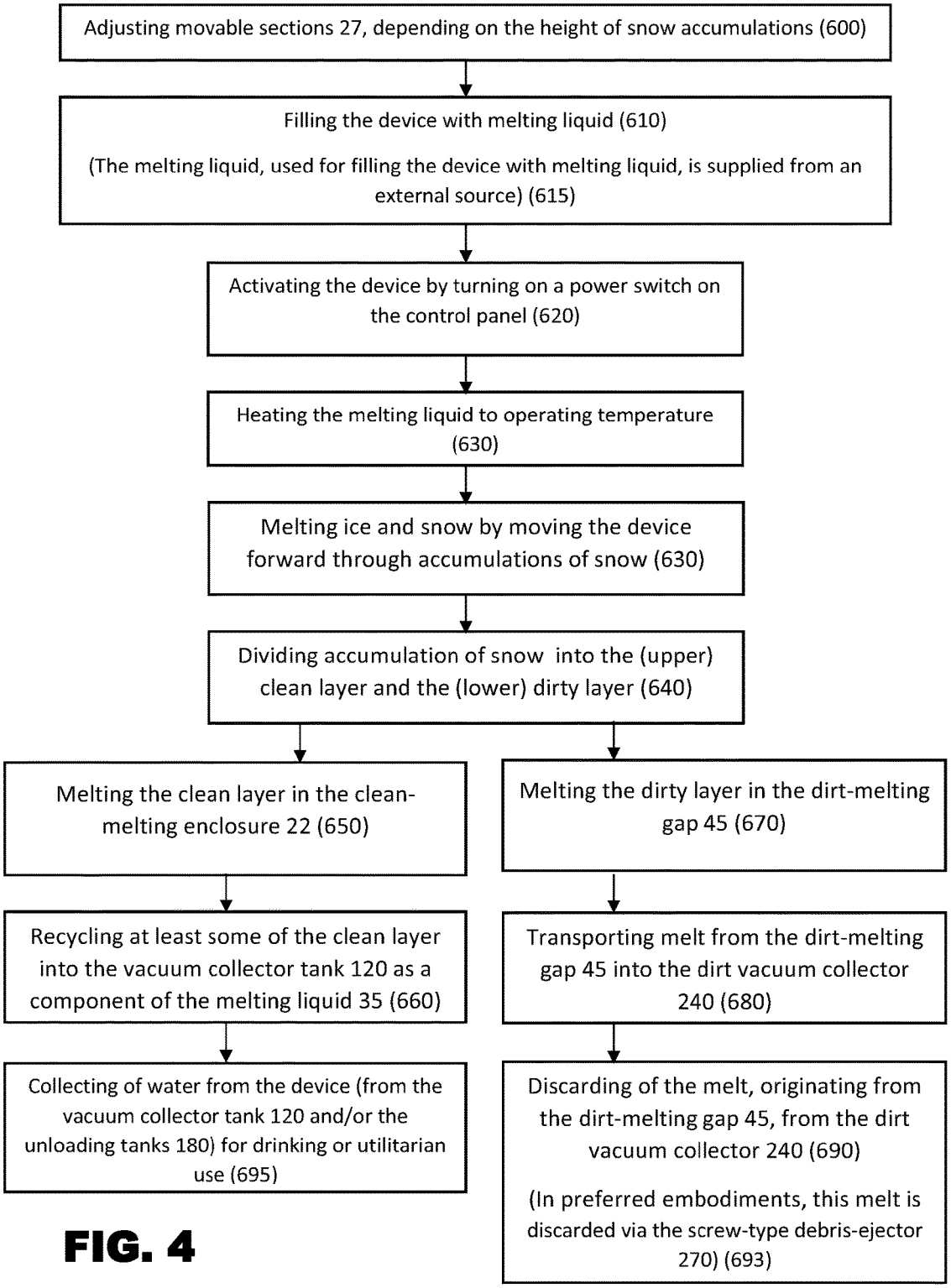
FIG. 4 is a flow chart, illustrating the methods for melting and utilization of ice and snow, and obtaining clean water.

The device 1 further comprises a plurality of pipelines 54, including (but not limited to) nozzle supply pipelines 55 (nozzle pipelines 55), indicated on FIG. 3. The device 1 further comprises a plurality of valves 56. The plurality of valves 56 comprises a number of valves, among which are nozzle valves 60, intended for controlling the flow to nozzles 30. Each of the nozzle pipelines 55, is connected to one of the plurality of nozzle valves 60, said valves configured for regulating flow through nozzle piplines 55. In preferred embodiments, nozzle valves 60 are electric solenoid valves. In the variants of FIGS. 1-3, nozzle valves 60 comprise ice-melting nozzle valve 70 for regulating (or turning on or off, if needed), the flow to the ice-melting nozzle(s) 40. Nozzle valves 60 are feedingly connected to (the term "feedingly, referring to "being supplied by") the melting liquid supply pipeline 80 (melting pipeline 80).

The device of the present invention comprises at least one heating element 90, intended for heating and maintaining the temperature of the melting liquid 35. In the preferred variants, such as the variant of FIG. 3, the heating element 90 is attached to the melting pipeline 80, heating the melting liquid 35 therein. However, in other variants, the heating element 90, or multiple such elements may be installed in other location, where the melting liquid 35 is stored or passes through (such as inside the melting-liquid unloading tanks). The extent of heating is set/controlled by the melting liquid temperature sensor 100 (temperature sensor 100). The temperature sensor 100 is preferably positioned on the melting liquid supply pipeline 80.

The melting liquid supply pipeline 80 further comprises collector valve 110. This valve is also preferably a solenoid valve. It functions in redirecting melting liquid 35 into a vacuum collector tank 120, when the device 1 is being initially loaded with melting liquid 35, in preparation for operation (recirculation mode).

The vacuum collector tank 120 is also referred to as clean water collector tank 120, or collector tank 120. It is preferably positioned inside the mobile platform 10 and is typically (although not necessarily) the first tank to be initially filled with the melting liquid 35, as the device 1 is being prepared for operation. Once the device is operational, the collector tank 120 acts as a receptacle for the returning melt of "clean" layers of snow, mixed in with the melting liquid 35 (and preferably recaptured warm air.) This mixture is typically clean enough and contains enough heat reserves to efficiently reuse/recycle as melting liquid 35 for further melting of snow. This "clean" mixture accumulates at the bottom of the melting enclosure 22, running down the curved floor 25 toward the back wall 24, where is sucked up into the collector tank 120. The melting enclosure 22 comprises at least one clean-melt pipeline 130, positioned at the bottom of the melting enclosure, adjacent to the back wall 24 and the floor 25. The "clean" mixture is sucked into the collector tank 120 through this clean-melt pipeline 130.

In preferred embodiments, warm air is supplied into the melting enclosure 22 via warm air pipeline 140. The collector tank 120 preferably comprises a collector vacuum pump 122 (collector vacuum 122). This vacuum sucks (warm) air out of the collector tank 120 through air pipeline 140 into the melting enclosure 22. This warm air inflow raises the temperature and creates additional air movement in the melting enclosure 22, thus facilitating the melting of snow. It also prevents suction of cold air from the outside into the melting enclosure 22. Suction of air by the collector vacuum 122 creates vacuum in the collector tank 120. This vacuum, in turn, facilitates the suction of clean melt into the collector tank 120 through the clean-melt pipeline 130.

The clean, recycled melt thus collects in the collector tank 120. The fill of the collector tank 120 is regulated by the fill-level sensor 150. Once the pre-set fill level is achieved, the overflow of clean melt from the collector tank 120 is released (preferably for disposal) through the overflow valve 160. This valve is also preferably a solenoid valve. The overflow is moved through the overflow valve 160 by the function of overflow pump 170. The same overflow pump 170 also functions to pump melting liquid 35 from the vacuum collector tank 120 into a plurality of melting-liquid unloading tanks 180 (unloading tanks 180).

Preferred variants of the device 1 comprise two unloading tanks 180, the first unloading tank 181 and the second unloading tank 182. The two unloading tanks in these embodiments are essentially similar to each other. Other embodiments of the present invention, especially larger embodiments, may comprise more than two unloading tanks 180. Preferably, the unloading tanks 180 are positioned lower (i.e. closer to the road surface) than the vacuum collector tank.

The unloading tanks 180 are intended to provide uninterrupted and stable supply of the melting liquid 35 into the system. For this reason, plurality of unloading tanks 180 is preferred to a single unloading tank 180. The melting-liquid unloading tanks 180 are configured for sequential unloading of the melting liquid 35. That is, at a certain point in the operating process of device 1, the nozzles 30 may be supplied by the first unloading tank 181. During this time, the second unloading tank 182 is preferably filling up from the collector tank 120.

The first unloading tank 181 and the second unloading tank 182 preferably comprise first low-fluid sensor 201 and second low-fluid sensor 102, respectively. Once the first unloading tank 181 has been "unloaded", as detected by the first low-fluid sensor 201, the system seamlessly switches to the second unloading tank 182 for supplying the nozzles 30. In the meantime, the first unloading tank 181 is being loaded with the melting liquid 35 from the collector tank, so that it may take over once again, once the first tank empties out. The unloading tanks 180 are thus functioning in a continuous, uninterrupted sequence.

Since, in the preferred embodiments, the collector tank 120 is being continuously supplied by the recycled melting liquid 35 and any losses are replenished by the "clean" melt (supplied by the clean collection tube 130), the collector tank 120 can continuously supply the unloading tanks for uninterrupted sequential performance.

The device 1 further comprises a distribution valve 190. The distribution valve 190 is functionally positioned between the collector tank 120 and the unloading tanks 180 and is adapted for flow control between the vacuum collector tank 120 and a plurality of melting-liquid unloading tanks 180. That is, it controls the flow of the melting liquid 35 between these tanks. More particularly, in the preferred embodiments, the distribution valve 190 provides for the sequential distribution of the melting liquid 35 from the collector tank 120 and sequential unloading of the unloading tanks 180. In the preferred embodiments, including the embodiment illustrated on FIG. 3, the distribution valve 190 is a solenoid valve. In other embodiments, other types of valves may be used. The valve, shown in the embodiment of FIG. 3 is a 3-position multi-channel solenoid valve. The distribution valve 90 of this embodiment comprises 2 control coils, a control coil A (coil 190A) and a control coil B (coil 190B), and 8 channels (channel valves) for liquid and gas exchange (referenced as 191, 192, 193, 194, 195, 196, 197 and 198).

The unloading tanks 180 are preferably unloaded by suction from the unloading pump 210. This pump also supports the pressure of the melting liquid 35 in the melting liquid supply pipeline 80 and at the heating element 90.

While clean melt is being recycled and recirculated at the upper melting levels of the device, dirty ice and debris, accumulating directly on the road surface 47, are entering the lower melting level of the device through the dirt-melting gap 45. The generally-dirty melt that forms here is processed separately and differently from the clean melt. The preferred embodiments of the device 1 comprise at least one rotary broom 220, said rotary broom positioned behind the dirt-melting gap 45. Preferred embodiments of device 1 comprise a plurality of (preferably two) counter-rotating rotary brooms 220. As ice-melting nozzle 40 in the dirt-melting gap 45 melts surface snow and ice with embedded impurities, this dirty melt is gathered and guided/swept by the rotary brooms 220 toward the dirt suction pipeline 230. The dirt suction pipeline 230 sucks in the dirty melt and small debris, forwarding them toward the dirt vacuum collector 240 (vacuum dirt collector 240, dirt collector 240). The dirt collector 240 is also configured to collect the overflow of the melting fluid 35, accumulating in the vacuum collector 120. The dirt collector 240 comprises the drying vacuum 245, configured for pumping air out of the dirt collector 240, thus creating vacuum. The air, accumulating in the dirt collector 240 (particularly the air sucked in through the dirt suction pipeline 230) is pumped out through the drying pipeline 260 via the drying heater 250. In the embodiment of FIG. 3, the drying pipeline 260 is positioned behind the dirt suction pipeline 230. Thus, the (preferably warm) air is being released onto the road surface 47 after most of the dirt and melt have been gathered off of it, drying the cleaned surface.

Fill level of the dirt collector 240 is monitored by the dirt collector sensor 290. Preferably the sensor may trigger halt of the device 1 operation if the tank is about to be overfilled.

In some embodiments, depending on the size of the device 1 and the size of the dirt collector 240, the dirt and debris accumulating in it may be manually removed at the end of use. However, in preferred embodiments, the dirty water and debris, collecting in the dirt collector 240 are ejected through the debris-ejector 270, such as the screw-type ejector, shown in FIG. 3. The ejector preferably moves the dirty water and debris into the separator 280. The separator 280 is preferably of the type, capable of separating the liquid from solids, and of retaining the solid debris, while releasing and disposing of the liquid. The simplest embodiment of such separator is a container with mesh bottom, releasing the liquid (into the drain/sewer/external tank, etc.) and retaining the solids. Alternatively the liquids as well as the solids may be retained for proper disposal later.

Favored embodiments of device 1 further comprise the air duct 300 (air filter 300). While the positioning of the air duct 300 is shown on the top side of the mobile platform 10, its positioning may vary, depending on device modifications. The air duct 300 functions to provide air into the unloading tanks 180, thus equalizing the pressure and ensuring even flow.

The initial filling of device 1 with melting liquid 35 is performed through a fill opening 310 (fill valve 310). The fill opening 310 is also preferably a solenoid valve. It should be noted that the term melting liquid 35 refers to any liquid that may be used to melt snow. It is foreseeable that water (preferably hot water at initial filling, or water warmed up by device 1) may be efficiently used for this purpose. It is also foreseeable that other liquids or water solutions (such as salt or alcohol solutions) may be used when higher melting efficiency is required or in the embodiments without the heating element 90. As the device 1 of preferred embodiments collects and recycles (or disposes of) the melt, the drawbacks of using salt (or other chemical) solutions to melt the snow are greatly reduced in comparison to the existing methods.

Preferred variants of the invention further comprise an elastic border 360, running along the bottom side 19 of the mobile platform 10 (See FIG. 1). Among many purposes of the elastic border 360 are the improvement of the melting and gathering efficiency and preventing splatter and run-offs.

Functionality Sequence

In order to prepare device 1 of the preferred embodiment for operation, preparatory sequence is initiated.

An outside water (melting liquid) supply source is introduced through the fill opening (solenoid) 310. Device 1 enters the preparatory mode. In this mode, fill-level sensor 150 is disabled. The fill opening 310 opens up to allow the inflow of liquid. Melting liquid 35 fills up the vacuum collector tank 120 until fill-level sensor 150 is activated. This activation shuts down the fill valve 310 and turns on the overflow pump 170 in order to fill up the first unloading tank 181. At this time, current is applied to coil A (190A) of the distribution valve 190. This sets the channel valves (channels) in the following positions:

Channel valve 191 shuts down the pipeline for unloading the tank;

Channel valve 192 shuts down atmospheric air inlet supply;

Channel valve 193 opens the pipeline for equalizing the pressure inside the unloading tank 181 and the vacuum collector tank 120;

Channel valve 194 supplies melting liquid 35 into the unloading tank 181;

Channel valves 195 to 198 are connected to the second unloading tank 182. They will thus be positioned oppositely to the channel valves described above. Particularly:

Channel valve 195 is closed and is not supplying melting liquid 35 into the unloading tank 182;

Channel valve 196, intended for equalizing the pressure inside the unloading tank 182 and the vacuum collector tank 120 is closed;

Channel valve 197 is open to provide atmospheric air inlet supply;

Channel valve 198 is open, allowing unloading of the melting liquid 35 from the tank into the melting liquid supply pipeline 80. However, the unloading pump in the device of preferred embodiment will not turn on, since the second low-fluid sensor signals the absence of liquid in the second unloading tank 182.

As the first unloading tank 181 is filling up, liquid level in the vacuum collector tank 120 is dropping until fill-level sensor 150 signals opening of the solenoid at the fill opening 310 to supply additional liquid into the vacuum collector tank 120. The process of filling the device 1 with melting liquid 31 from external source will continue until the first unloading tank 181 is filled up and fill-level sensor 150 triggers closing of the solenoid at the fill opening 310.

At this point, the distribution valve 190 switches its position. The charge will switch away from coil A (190A) to coil B (190B), reversing the position/setting of all channel valves above. Accordingly, the first unloading tank 181 will receive the inflow of atmospheric air, equalizing its internal pressure at atmospheric pressure, and start unloading via the unloading pump 210. In contrast, the second unloading tank 181 will equalize its internal pressure with that of the vacuum collector tank 120 and will start filling up from the vacuum collector tank 120.

In the preferred embodiments, heating element 90 will turn on to heat up melting liquid 35. In the meantime, collector valve 110 will switch into a position, allowing for circulation of the melting liquid 35 via the route of: vacuum collector tank 120 to overflow pump 170, to unloading tanks 180, to unloading pump 210, to heating element 90. The temperature sensor 100 monitors the temperature of the melting liquid 35 within the pipeline. Optimal operational temperature may be settable by the user or preset by the manufacturer of the device 1. Once the set operational temperature is reached, collector valve 110 is switched, the preparatory stage is complete, and the device is ready for melting of snow and ice. Preferably, the user is informed of the device readiness via a signal, such as a "ready" light on a control dial, or another type of notification.

It should be noted that for normal functionality of the device in preparatory stage that the throughput of the overflow pump 170 exceed the amount of melting liquid 35, provided from the external source.

Prior to operating device 1 to melt snow, movable sections 27 must be adjusted, so that the melting nozzles 30 of the upper level are only slightly above the height of snow accumulations. In the preferred embodiments, where melting nozzles 30 are embodied in nozzle tubes 31, it is preferable to position the upmost nozzle tube 31 approximately 1" above the snow accumulation. Of course, this distance may somewhat vary in other embodiments of the present invention. In preferred embodiments, once the movable sections 27 are adjusted so that upmost nozzle tube 31 is just above the snow cover, other nozzle tubes 31 position themselves below, with each nozzle tube 31 separated from the neighboring one by roughly the same distance, thus each processing approximately the same height of snow. However, if the height of snow is relatively low and the upmost nozzle tube 31 (or the upmost row of nozzles 30) is positioned so low that the vertical distance between the nozzles is less then 3 inches, then it is advisable to lower the upmost of the nozzle tubes 31 down to the second highest of the nozzle tubes 31 and to shut down the nozzle valve 60, associated with the highest of the nozzle tubes 31. This way, the upmost nozzle tube will be turned off, and stream released from melting nozzles 30, located on the second upmost nozzle tube 31 will be melting/processing the upper levels of snow, while the rest of the snow will be processed by nozzles 30, located in the lower nozzle tubes 31.

Positioning of melting nozzles 30 at the appropriate height is preferably performed by the user, although in some embodiments such height adjustment may be automatic. Once the melting nozzles 30 are positioned at the appropriate height, nozzle valves 60, including ice-melting nozzle valve 70 (preferably solenoids), open up for all nozzle supply pipelines 55, associated with functioning melting nozzles 30.

As described above, the nozzles 30 are aimed substantially downwards at a slight angle toward the back wall 24. Hot pressurized streams of melting liquid 35 are released by the nozzles 30 downward and slightly backward, these streams, forming a thermo-liquid surface 36. This surface 36 is essentially a wall of melting liquid 35 that melts vertical layers of ice and snow upon contact, via its thermal and mechanical energy.

The melt, gathering on the top of the floor 25 is sucked in by the clean collection tube 130 to the vacuum collector tank 120. Similar thermo-liquid surfaces 36 are formed by the melting nozzles 30, located in the melting enclosure 22 (i.e. above the floor 25) and in the dirt-melting gap 45 (i.e. below the floor 25). However, in the preferred embodiments, the ice melting nozzle 40 (that is, the one located in the dirt-melting gap 45) has a steeper angle. It is preferably aimed downward at an angle of approximately 45 degrees to the road surface 47 and aimed toward the rotary brooms 220. The rotary brooms 220 in turn gather up the melt and the dirt and push them toward the dirt suction pipeline 230, which forwards them to the dirt vacuum collector 240.

As device 1 moves forward, the thermo-liquid surfaces 36 come in contact with snow. The snow is separated by the device 1 into two parts—a clean part and a dirty part. The higher layers of snow accumulations are generally cleaner and enter the higher-positioned clean-melting enclosure 22. There, they melt and are recycled into the vacuum collector tank 120. The dirty part of the snow is melted by the ice-melting nozzle 40, while still on the road surface 47. It is mechanically effected on by the streams and the rotary brooms 220, mixing with dirt and debris, prior to its collection into the dirt vacuum collector 240.

A steeper, (preferably approximately 45 degree) angle of spray in the dirt-melting gap 45 allows for more efficient separation of frozen layer that is often present between the snow accumulations and the road surface 47. Upon contact with snow, hot liquid of the thermo-liquid surface 36 enters the porous structure of snow, melting and destroying mechanical connections between snow crystals. The mechanical effect of the pressured streams destroys the structure of snow, allowing individual crystals to melt in the liquid flow. This explains why the looser and softer the snow is, the faster it melts (see thermal calculations below).

In the process of operation of device 1, the clean melt reabsorbed/recycled into the system, compensates for the loss of the melting liquid 35 in the dirt-melting gap zone, where the melting liquid 35 is irrevocably expended. If in the course of operation, vacuum collector tank 120 gets close to overfilling, fill-level sensor 150 activates to send signal for opening up the overflow (solenoid) valve 160. Once the overflow valve 160 opens up, part of the excess melt will be pumped by the overflow pump 170 into the dirt vacuum collector 240. In case there is insufficient clean melt to recycle and sustain the operations, both unloading tanks 180 will empty out and the first low-fluid sensor 201 and the second low-fluid sensor 202 will both activate and signal an emergency stop. In this case, preferably, the device 1 will light up a message to the user, informing them of low melting liquid and/or advising them to add melting fluid from external source in order to continue operation of the unit.

Generally, the system may run out of the melting liquid 35 if insufficient amounts of melt are being recycled in the clean melting enclosure 22 to maintain continuous operation. This may happen if the movement of the device 1 through snow accumulations is too slow to supply sufficient clean melt or if melting is too slow (which may happen if temperature or pressure of the melting liquid 35 is low, for example). Some embodiments of the device 1 comprise sensors that detect that the usage of melting liquid exceeds replenishment. In these embodiments the user may be warned of insufficient recycling by a notification on a control panel, such as a message or a warning light, and advised to increase the speed or raise pressure and/or temperature of the melting liquid 35. Alternatively, other embodiments may sense insufficient recycling rate and automatically adjust the melting characteristics of the device by changing the speed, temperature, pressure, etc.

When accumulations of snow are low (for example, under 2 inches), the device 1 may also be used. However, in this case only the ice-melting nozzle(s) 40, in the dirt-melting gap 45 will be functional. Nozzle valves for other melting nozzles 30 will be shut down, either by user or by a snow accumulation sensor on the machine. In this case, no melt will accumulate in the clean melting enclosure 22 for recycling. Accordingly, the device will have to be connected to an external liquid source or be limited to the melting liquid 35 in its tanks.

The device is protected from from harsh collisions via at least one shock absorber 340 and the limiter 350. As described above, once the melting enclosure 22 encounters an obstacle in its forward movement, shock absorber 340 travels backwards, eventually encountering and triggering the limiter 350. The limiter 350 halts the rearward movement of the shock absorber 340 and, preferably, shuts off the device 1.

In simplest variants of the preferred embodiments, the device 1 is powered via electric cable, plugged into a standard wall outlet. In this case, the heating element 90 is an electric heater. In preferred embodiments, where autonomous functionality is required, an onboard electric battery may be used to supply electric power. In these embodiments, a gas or liquid-fueled heater may be used to heat up the melting liquid 35.

Yet in other preferred embodiments, power sources such as a diesel electro generator or fuel cell may be used. The two latter sources can each combine as a dual source of electric and heat energy, while also having a high efficiency ratio. If one of these two sources is used, the device 1 may be used as an independent power supply source. This capability of the device to act as a power generator (or back-up generator) may be particularly advantageous in remote areas without reliable electricity supply (such as remote outposts, temporary military or refugee camps, Arctic stations, etc.). In addition to providing electricity, the device is capable of melting clean layers of snow in order to quickly and efficiently provide large amounts of warm drinkable water, which may be a feature critically-important to survivability in situations, referenced above.

Calculations of the Thermal Process of Melting Snow with Thermo-Liquid Surface, while the Device 1 is in Motion.

Figure 5:
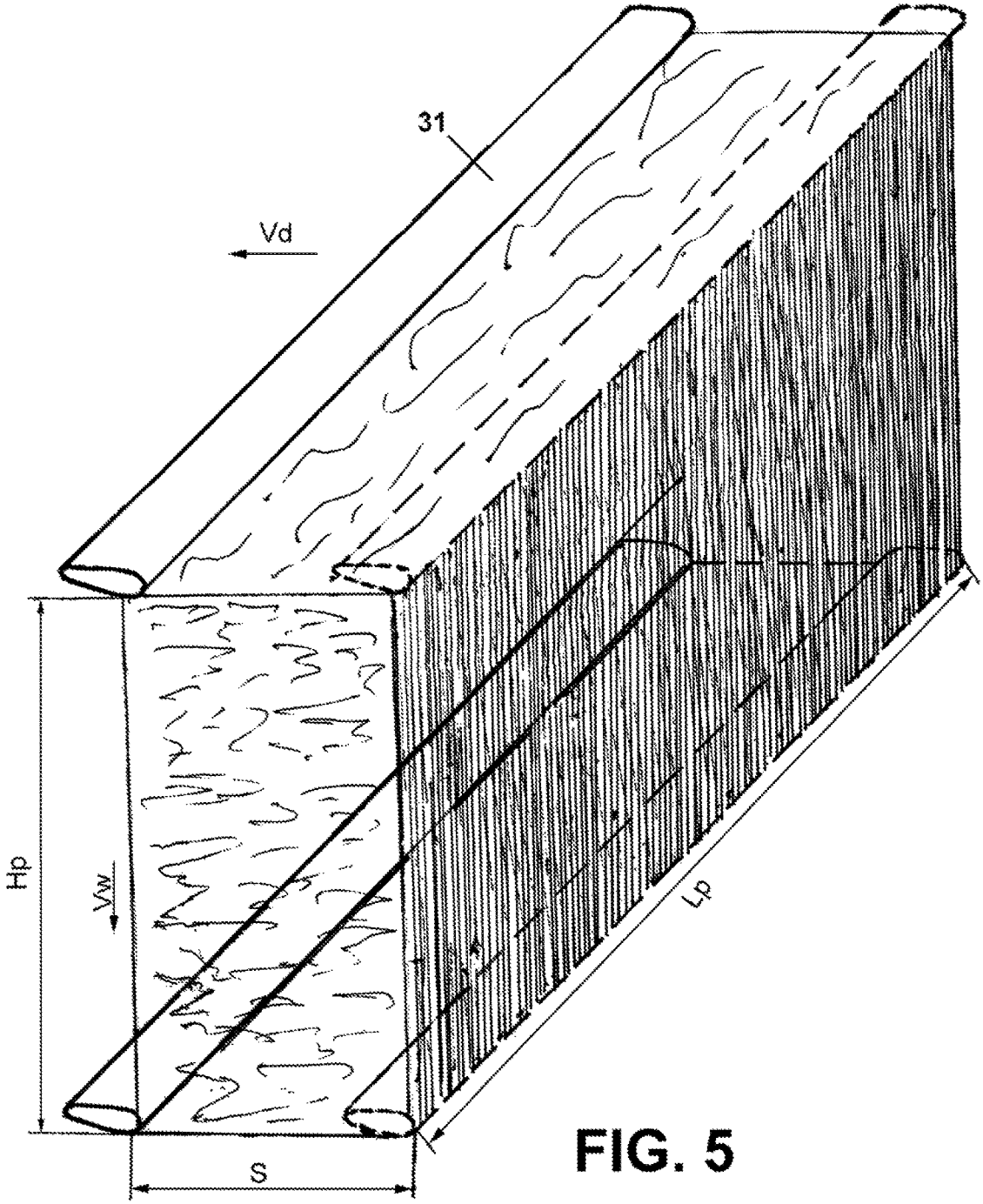
FIG. 5 is a depiction of motion of the nozzle tubes of a preferred embodiment through the accumulations of snow. The depiction is provided as illustration for the calculations of the thermal process of melting snow with the device of the present invention.

The calculation, presented below is illustrated on FIG. 5. In order to perform the calculation, parameters of one of the preferred embodiments are taken. Parameters of other preferred embodiments of the present invention may differ.

Vd—device's speed of movement (m/s)—0.1
Dj—diameter of nozzle opening (mm)—1.5
l—distance between the nozzles (mm)—4
Vw—speed of water, moving in a stream/jet (m/s)—2
Hp—distance between nozzle tubes (m)—0.1
Lp—length of a nozzle tube (m)—1
Tw—hot water temperature (in degrees Celsius)—75
Cw—specific heat of water (j/kg C)—4200
Cs—specific heat of snow (j/kg C)—2100
s—enthalpy of fusion for snow (j/kg)—330
w—specific gravity of water (kg/m$^3$)—1000
s—specific gravity of snow (kg/m$^3$)—330

1. Calculating time it takes for hot water to pass the distance between the nozzle tubes:

$$t=Hp/Vw=0.1/2=0.05 \text{ s}$$

2. Determining distance traveled by device in time t:

$$S=Vd\times t=0.1\times 0.05=0.005 \text{ m}$$

3. Determining mass of snow, treated in time t:

$$Ms=(S\times Lp\times Hp)\times s=(0.005\times 1\times 0.1)\times 330=0.165 \text{ kg}$$

4. Determining the amount of heat required for melting the mass of snow Ms:

$$Qs=Ms\times s=0.165\times 330=54.45 \text{ j}$$

5. Determining the mass of water used in time t:

$$Mw=(Dj/4\times Hp\times Lp/l)\times w$$

$$Mw=(3.14\times 0.0015/4\times 0.1\times 1/0.004)\times 1000=0.0441 \text{ kg}$$

6. Determining the amount of heat in water at temperature of 75 degrees Celsius, with the mass Mw:

$$Qw=Cw\times Mw\times Tw=4200\times 0.0441\times 75=13909.6 \text{ j}$$

7. Determining the time of melting of snow with the mass Ms:

determine the power of thermo-liquid surface during time t:

$$Ww=Qw/t=13909.6/0.05=278195 \text{ j/s}$$

determine melting time for snow with mass Ms:

$$t=Qs/Ww=54.45/278195=0.00019 \text{ s}$$

8. Determine the temperature of secondary water (a mixture of previously-used water and melt):

determine the amount of heat expended to melt the snow and heat melted water to balanced temperature:

$$Qmw=Qs+Cw\times Ms\times Tb$$

determine heat losses in thermos-liquid surface:

$$Qww=Cw\times Mw\times(Tb-Tw)$$

consider acceptable error Qmw=Qww $$(Qs+Cw\times Ms\times Tb)=Cw\times Mw\times(Tb-Tw)$$

Determine the temperature of secondary water $$Tb=(Tw-Qs/Cw)/Ms+Mw$$

$$Tb=(75-5445/4200)/0.044+0.165=9 \text{ degrees Celsius.}$$

Conclusions Based on the Above Calculations:

1. With forward movement of the device at a speed of 0.1 m/s, with hot water (melting liquid 35) supplies at 75 degrees Celsius, dense snow with density of 330 kg/m$^3$ will melt completely.
2. Temperature of the secondary water (a mixture of previously-used water and melt) established after mixing −9 degrees Celsius.
3. Pump efficiency required for three nozzle tubes with parameters provided above, is equivalent to 150 l/m.

The Purpose and Functionality of the Plurality of Melting-Liquid Unloading Tanks is as Follows.

Unloading tanks 180 are intended for stable continuous uninterrupted flow of the melting liquid 35 through the system to the melting nozzles 30. Unloading tanks 180 ensure constant pressure of the melting liquid 35 as it flows via the unloading pump 210, to heating element 90 and further on in the liquid supply pipeline 80.

One of the major reasons for adoption of unloading tanks 180 is due to the fact that melting liquid 35 that goes through the system on its way to ejection from nozzle valves 60, must pass the vacuum collector tank 120. Air pressure, within the vacuum collector tank 120 may be subject to frequent and significant fluctuations. The changes depend, in part, on the load of the clean collection tube 130, which sucks in the melt from the floor 25. The amount of the melt, momentary obstructions, unmelted bits of ice and snow, angle of the floor 25 (which may change with the angle of the road surface 47) and numerous other factors will effect the load of the clean collection tube 130 and vary the pressure within the collector tank 120. The changes in pressure inside the vacuum collector tank 120 may effect the pressure and flow of the melting liquid 35, as it leaves the vacuum collector tank 120. If these fluctuations are not addressed, they may have an effect on stable functionality of device 1.

Functionality of each individual tank of the plurality of unloading tanks 180 is essentially divided into two distinct functional stages. The first stage is filling of the tank with melting liquid 35 (such as water). This is done at air pressure equivalent to that in the vacuum collector tank 120. The second stage is unloading of melting liquid 35 from the tank at steady atmospheric pressure. Thus, a plurality of unloading tanks 190 is required to insure that supply of melting liquid 35 is uninterrupted. Preferred embodiments have two unloading tanks. However it is foreseeable that some of the embodiments, especially larger ones may have more than two unloading tanks. Having more tanks would allow the device 1 to have higher reserves of melting liquid and better compensate for any uneven recycling of melting fluid 35 and melt. Such an adaptation would be useful in circumstances where the device is used in areas of uneven accumulations of snow.

The distribution valve 190, controlling the functionality of unloading tanks 180 was described in detail above. It is preferably a 3-position multi-channel solenoid valve, comprising 2 control coils, a control coil A (coil 190A) and a control coil B (coil 190B), and 8 channels (channel valves) for liquid and gas exchange (referenced as 191, 192, 193, 194, 195, 196, 197 and 198).

In this embodiment, 4 of the 8 channels are connected to the first unloading tank 181 and the other 4 of the 8, to the second unloading tank 182. Preferably, at least 2 of the channels connected to each of the tanks are the air channels. One of the air channels serves to equalize the air pressure of unloading tank with the vacuum collector tank 120, while the other serves to provide ambient air and to equalize the tank at atmospheric pressure. Likewise, the other two of the four channels, connected to each unloading tank are water channels. One if these water channels serves to supply melting liquid 35 from the vacuum collector tank 120, while the other is intended for unloading melting liquid 35 from the unloading tank toward the nozzle valves 60.

The three positions of the 3-position multi-channel solenoid valve are as follows. By default, all channels are closed and there is no electric charge supplied to either of the coils. This is position 1. As charge is applied to either coil A (190A) or coil B (190B), the channels (valves) take on alternative and opposite states of functionality. Thus, if charge is applied to coil A (190A) (Position 2), the first unloading tank 181 will start taking on the melting liquid 35 through channel 194. The air pressure in the tank will be kept constant with the vacuum collector tank 120 through the open channel 193. Channel 191, connecting the tank with atmospheric air supply is closed. Channel 192, which allows for unloading of the melting liquid 35 is likewise closed.

At the same time, in position 2, the states of the channels connected to the second unloading tank 182 are reversed (from those of the channels connected to the first unloading tank 181). Thus, channel 195, which controls supply of the melting liquid 35, is closed. Channel 196 is closed, preventing air exchange with the vacuum collector tank 120. However, channel 197 is open, allowing for outside atmospheric air supply. Likewise, open channel 198 allows unloading of the melting liquid 35 via the unloading pump 210.

Once the second unloading tank 182 is emptied out, charge is applied to coil B (190B). This reverses the state of all channels (valves) to the opposite state. This is position 3. Now, the first unloading tank 181 will start unloading, while the second unloading tank 182 will be loading up with the melting liquid 35.

The method of setting up and melting of ice and snow with device 1 comprises the steps described below.

The user inspects the device to ensure that it is in good functional condition. The user then adjusts movable sections 27, depending on the height of snow accumulations (600). The adjustments are such that the upmost melting nozzles 30 are only slightly above the height of snow accumulations. In the preferred embodiments, where melting nozzles 30 are embodied in nozzle tubes 31, it is preferable to position the upmost nozzle tube 31 approximately 1" above the height of snow accumulations (605). This preferred distance above the snow may somewhat vary in other embodiments of the present invention and may also depend on the evenness of the levels of snow accumulations. User of the device 1 may elect to adjust the movable sections 27 to the highest levels of snow or to adjust them during the melting process to ensure smallest possible area of the clean-melting enclosure 22, thus ensuring maximum melting efficiency. Alternatively, in some advanced embodiments, a snow-level sensor, such as a camera on the device 1 determines the height of snow accumulations and automatically adjusts the height of the nozzles for maximum efficiency.

In preferred embodiments, the device 1 comprises a control panel 400. Preferably, such control panel is positioned on the body of the mobile platform 10, in a place easily accessible by the user, as shown in FIG. 1. In other embodiments of the device 1, the control panel 400 may be a designated remote control or a remote control application, such as an app installed on a mobile accessory (such as a smart phone), wirelessly connected with the device 1.

In one possible embodiment of a control panel 400 the user activates the device 1 by turning on (620) (or otherwise activating) a power switch 410 on the control panel 400. Preferably the control panel 400 comprises light indicators of status. Some of the controls and status indicators that may be represented on the panel of preferred embodiments are "system is filled up", "system is empty", "trash release", as well as separate switches for each of the nozzle valves 60, allowing for selective activation of each level of nozzle tubes 31. Such switches for nozzle valves may be labeled "level 1", "level 2", "level 3", etc. Preferred embodiments also comprise a separate control for the ice-melting nozzle valve 70, labeled "ice melting". Of course, controls and control panel adjustable functions available to the user may vary among embodiments.

In some cases of use, if the accumulations of ice and snow are very low, it would make sense for the user to have only the ice-melting function turned on in order to conserve the melting liquid 35 and energy. However, since in this mode, there no clean-melt is recycled, and since at low snow accumulations the snow may still be soft and ice absent, preferred embodiments of the invention allow the user to control the amount of melting fluid 35 used. Thus, instead of comprising and on/off regulators for the ice melting function, these preferred embodiments comprise an adjustable ice-melting dial 480. This dial 48 allows the user to adjust the amount of water supplied to the ice-melting nozzle(s) 40. In more complex embodiments, dials may be used instead of on/off switches all other melting nozzles 30 as well.

Preferred embodiments further comprise a switch for "trash release". This switch activates the screw-type debris-ejector 270. These embodiments also comprise a three-position selector switch, which allows setting of the operation mode for the device 1. The modes are preferably "off", "prep", "melting".

In one example of a preferred variant of the invention, once the device 1 is powered up, light-up indicators on the control panel 400 inform the user of the readiness state of the device 1. For example, "system is empty" or system is filled up" indicators may light up. The device 1 must be filled up (610) with melting liquid 35 prior to operation. If the device 1 is empty, sensors will cause the "system is empty" indicator to come on. In this case, the user must fill up the device 1 with melting fluid 35, supplied from an external source (615). In cases, where regular tap water is used as melting fluid 35, the device 1 may be connected to tap via a hose through the fill opening 310. In cases where melting liquid 35 is a fluid other than tap water, such fluid (or additives) may be added from external tanks through the fill opening 310. In the simplest embodiments of device 1, the vacuum collector tank 120 and unloading tanks 180 may be manually filled by user.

In the preferred embodiments, the initial fill-up is automatic. Fluid outlet of an open external melting liquid 31 source is connected to the fill opening 310. The fill opening 310, preferably of solenoid valve type, opens up once the selector switch is set to the "prep" mode. The supply of fluid will come into the vacuum collector tank 120 and will continue until the fill-level sensor 150 signals the filling of unloading tanks 180 (preferably the filling is done by the overflow pump 170). The distribution valve 190 will switch from a neutral position (position 1) into one of the functional positions (positions 2 or 3), as described above. As unloading tanks 180 are getting filled up, the vacuum collector tank 120 is being topped off via the fill opening 310, as the liquid level gets low enough for fill-level sensor 150 to allow top-offs. Once the system is filled up, preferably the indicator "system is empty" turns off and the indicator "system is filled up" comes on, or the user is otherwise informed that this step is completed.

In the preferred embodiments the melting liquid is heated to the operating temperature (630) by the device 1. Preferred operating temperature, as described in the calculations above, is at approximately 75 degrees Celsius. Of course, this preferred temperature is variable among different embodiments and operating conditions. In the embodiments shown, the heating is performed by the heating element 90. It is possible that liquid supplied from the external source may already be at the preferred temperature or be deemed "hot enough" to initiate melting. In other cases, user will wait for the melting liquid 35 to heat up to the required temperature prior to initiating the melting operation.

User of the device melts ice and snow by moving the device forward through accumulations of snow (640). The preferred speed of movement is determined, as shown in the calculations above. Of course, as the variables (such as the temperature of water, density of snow, power of the pumps and heaters, etc.) change, the speed with which the device may be moved, is adjusted. The device 1 shown in FIG. 1 is intended to be manually moved/pushed by user via the push-handle 12. However in other preferred embodiments, it may be self-propelled or may be attached to and pushed forward by another vehicle.

As the device 1 is moved through the accumulations of ice and snow, it essentially divides the accumulations of snow (640) into the (upper) clean layer 16C and the (lower, over the road surface) dirty layer 16D. The clean layer 16C is melted (650) in the clean-melting enclosure 22. At least some of the clean layer 16C is then recycled (660) into the vacuum collector tank 120 as a component of the melting liquid 35. The dirty layer 16D is melted and processed in the dirt-melting gap 45 (670). Melt, resulting from melting of the dirty layer 16D is preferably transported (sucked) from the dirt-melting gap 45 into (680) the dirt vacuum collector 240, from which it is later disposed of (discarded) (690), preferably via the debris-ejector 270 (693).

The device 1 is environmentally-friendly. If pure hot water is used as a melting liquid 35, then melt from the clean layer 16C remains clean, as it gets recycled into the vacuum collector tank 120 and into the unloading tanks 180. Provided the upper accumulations of snow are naturally unpolluted, clean water may be collected from these tanks (695) for drinking or utilitarian use, if required. In cases where the device 1 is being used to melt snow with the sole purpose of collecting water, it is advisable to shut down the ice-melting nozzle valve 70 to avoid unnecessary loss of water through the ice-melting nozzle 40.

The device of the present invention, thus provides a number of novel and unique solutions and provides unmatched convenience, efficiency and versatility in melting ice and snow accumulations. Among the numerous solutions, implemented in the device and the methods, are the uniquely-separated clean-melting enclosure and dirt-melting gap that allow for dividing of snow into the recyclable clean layer and dirty layer. This allows, among other things, not just for continuous operation without the need to refill, but for preservation and recycling of most of the expended heat energy. The clean-melting enclosure provides a melting space that is uniquely enclosed from all sides by the back and side walls, a floor and a roof, as well as by the thermo-liquid surface 36 from the front. This further conserves melting liquid 35 for recycling, by preventing splatter, and conserves energy by preventing heat loss. The unique adjustably-expandable melting section allows for height adjustments to effectively accommodate and melt varying accumulations of ice and snow. Continuous uninterrupted and reliable supply of melting liquid is ensured by a unique and innovative combination of sequentially-unloading melting-liquid unloading tanks. The unique dirt-melting gap is specifically adopted for melting layers of dirty compacted snow and ice frozen onto the surface. Not only does the device melt these layers, but also removes the dirty melt into the dirt vacuum collector. Unlike the snow melting machines of the prior art, the device of the present invention does not scratch the road surfaces or move snow around. Nor does it leave behind salt or melt. Most of the liquid used to melt the snow is either recycled or moved into the dirt vacuum collector for disposal. The device leaves surfaces clean and dry. The device is easy and inexpensive to manufacture. It is simple to operate, and as above calculations illustrate, highly efficient in melting of ice and snow.

It is to be understood that while the apparatus and method of this invention have been described and illustrated in detail, the above-described embodiments are simply illustrative of the principles of the invention and the forms that the invention can take, and not a definition of the invention. It is to be understood also that various other modifications and changes may be devised by those skilled in the art, which will embody the principles of the invention and fall within the spirit and scope thereof. It is not desired to limit the invention to the exact construction and operation shown and described. The spirit and scope of this invention are limited only by the spirit and scope of the following claims.

I claim:

1. A mobile ice and snow utilization device, comprising:

a. a mobile platform, the platform having a front side, a rear side, and a bottom side, said platform comprising a forwardly-attached, adjustably-expandable melting section, attached to the front side of the platform, wherein, b. the melting section comprises a clean-melting enclosure and a dirt-melting gap, c. said clean-melting enclosure comprising:
i. an open front end;
ii. a back wall, a plurality of side walls, a floor and a roof;
iii. a plurality of telescopically-movable sections,
iv. wherein at least some of the telescopically-movable sections of the plurality of telescopically-movable sections are slidably overimposed over at least one adjacent telescopically-movable section, thus creating a telescopically-expandable vertical surface;
d. the dirt-melting gap is positioned below the clean-melting enclosure and is separated from the clean-melting enclosure by the floor;
e. the melting section further comprising a plurality of melting nozzles, said melting nozzles configured to release a pressurized stream of melting liquid,
f. wherein at least some of the plurality of melting nozzles are positioned in the open front end of the clean-melting enclosure and at least one of the plurality of melting nozzles is positioned below the floor, in the dirt-melting gap;
g. wherein at least some of the plurality of melting nozzles are movably and adjustably positioned in the clean-melting section by being connected to at least one of the plurality of telescopically movable sections, and thus capable of movement in relation to other melting nozzles of the plurality of melting nozzles, by moving along with the movable sections; the device further comprising:
h. a control panel,
i. a plurality of pipelines,
j. a plurality of pumps,
k. at least one heating element,
l. a vacuum collector tank,
m. a plurality of melting-liquid unloading tanks, said plurality of melting-liquid unloading tanks configured for sequential unloading of the melting liquid;
n. a plurality of valves, said plurality of valves comprising at least one distribution valve.

2. The device of claim 1 wherein the distribution valve is adapted for flow control between the vacuum collector tank and the plurality of melting-liquid unloading tanks;
and wherein the dirt-melting gap comprises an ice-melting nozzle.

3. The device of claim 2, wherein wherein
the floor slants downward, as it extends from the open front end toward the back wall;
and wherein the clean-melting enclosure comprises a warm air pipeline.

4. The device of claim 3, wherein
at least some of the plurality of valves are solenoid valves, and wherein
a plurality of valves comprises a plurality of nozzle valves, and
a plurality of pipelines comprises a plurality of nozzle supply pipelines;
with each nozzle valve of said plurality of nozzle valves attached to at least one of the plurality of nozzle supply pipelines; wherein
the plurality of pipelines comprises a liquid supply pipeline, and
at least some of said plurality of nozzle valves are feedingly connected to the liquid supply pipeline.

5. The device of claim 4, wherein the clean-melting enclosure comprises at least one clean-melt pipeline; wherein
the vacuum collector tank comprises a collector vacuum pump; and
the distribution valve is a 3-position multi-channel solenoid valve.

6. The device of claim 5, wherein the at least one clean-melt pipeline is positioned in the clean-melting enclosure, adjacent to the floor and to the back wall.

7. The device of claim 6, wherein at least some of the melting nozzles of the plurality of melting nozzles are aimed substantially downward; and wherein the dirt-melting gap comprises at least one ice-melting nozzle, pointed at a downward angle into the dirt-melting gap.

8. The device of claim 7, further comprising a plurality of horizontally-positioned nozzle-tubes;
wherein at least some of the plurality of the melting nozzles are attached to at least one of a plurality of horizontally-positioned nozzle-tubes,
said plurality of nozzle-tubes positioned parallel to each other and to the floor of the melting enclosure;
the nozzle tubes being positioned at a plurality of heights within the melting section.

9. The device of claim 7, wherein the melting nozzles are positioned, so that pressurized stream of melting liquid released from at least some melting nozzles of the plurality of melting nozzles combines with pressurized stream of melting liquid released from at least some of nearby melting nozzles to form a thermo-liquid surface.

10. The device of claim 8, further comprising at least one rotary broom, said rotary broom positioned behind the dirt-melting gap; and
wherein the bottom side of the mobile platform comprises a dirt suction pipeline and a drying pipeline,
said drying pipeline positioned behind the dirt suction pipeline.

11. The device of claim 10, further comprising a melting liquid temperature sensor and a vacuum dirt collector; wherein
at least one rotary broom comprises a plurality of counter-rotating rotary brooms;
and wherein at least some of the plurality of telescopically-movable sections comprise a portion of the back wall, said portion of the back wall being integrally connected with two portions of side walls adjacent to it.

12. The device of claim 10, further comprising a fill-level sensor 150, an overflow valve, a debris ejector, and an air duct; wherein
the at least one heating element is an electric heater.

13. The device of claim 8, wherein at least some of the plurality of melting-liquid unloading tanks are positioned lower than the vacuum collector tank.

14. The device of claim 8, wherein the melting section is rotatably attached to the melting platform, said attachment configured for vertical rotation of at least part of the melting section.

15. The device of claim 8, wherein the device further comprises at least one guide and wherein at least some of the back wall movable sections comprise a plurality of eyelets, the plurality of eyelets extending from the back wall movable sections rearwards; wherein the guide passes through at least some of the plurality of eyelets.

16. A method for melting and utilization of ice and snow, comprising the steps of:
a. providing a mobile ice and snow utilization device of the type comprising:
i. a mobile platform, the platform having a front side, a rear side, and a bottom side, said platform comprising a forwardly-attached, adjustably-expandable melting section, attached to the front side of the platform, wherein, ii. the melting section comprises a clean-melting enclosure and a dirt-melting gap, iii. said clean-melting enclosure comprising:

1. an open front end;
2. a back wall, a plurality of side walls, a floor and a roof;
3. a plurality of telescopically-movable sections,
4. wherein at least some of the telescopically-movable sections of the plurality of telescopically-movable sections are slidably overimposed over at least one adjacent telescopically-movable section, thus creating a telescopically-expandable vertical surface;

iv. the dirt-melting gap is positioned below the clean-melting enclosure and is separated from the clean-melting enclosure by the floor;

v. the melting section further comprising a plurality of melting nozzles, said melting nozzles configured to release a pressurized stream of melting liquid, vi. wherein at least some of the plurality of melting nozzles are positioned in the open front end of the clean-melting enclosure and at least one of the plurality of melting nozzles is positioned below the floor, in the dirt-melting gap;

vii. wherein at least some of the plurality of melting nozzles are movably and adjustably positioned in the clean-melting section by being connected to at least one of the plurality of telescopically movable sections, and thus capable of movement in relation to other melting nozzles of the plurality of melting nozzles, by moving along with the movable sections; the device further comprising viii. a control panel, ix. a plurality of pipelines, x. a plurality of pumps, xi. at least one heating element, xii. a vacuum collector tank, xiii. a plurality of melting-liquid unloading tanks, said plurality of melting-liquid unloading tanks configured for sequential unloading of the melting liquid;

xiv. a plurality of valves, said plurality of valves comprising at least one distribution valve xv. the control panel comprises a power switch;

b. adjusting the plurality of telescopically-movable sections to position at least one of the plurality of melting nozzles above snow accumulations, c. filling the device with melting liquid, d. activating the device by turning on the power switch on the control panel, e. moving the device forward through accumulations of snow.

17. The method of claim 16, wherein the melting liquid is predominantly comprised of water and wherein the melting liquid used for filling the device with melting liquid is supplied from an external source, the method further comprising the steps of:

a. heating the melting liquid to operating temperature;

b. dividing snow accumulation into clean snow layer and dirty snow layer, c. melting of the clean layer in the clean-melting enclosure, d. recycling at least some of the clean snow layer into the vacuum collector tank for reuse as a component of the melting liquid;

e. melting the dirty snow layer in the dirt-melting gap.

18. The method of claim 17, the method further comprising the steps of:

a. transporting melted dirty snow layer from the dirt-melting gap into the dirt vacuum collector;

b. Discarding of the melt, resulting from melted dirty snow layer, from the dirt vacuum collector.

19. The method of claim 18, wherein the device further comprises a debris-ejector, and wherein the melt, resulting from melted dirty snow layer is discarded via the debris-ejector.

20. A method for obtaining clean water, comprising the steps of:

a. providing a mobile ice and snow utilization device of the type comprising:

i. a mobile platform, the platform having a front side, a rear side, and a bottom side, said platform comprising a forwardly-attached, adjustably-expandable melting section, attached to the front side of the platform, wherein, ii. the melting section comprises a clean-melting enclosure and a dirt-melting gap, iii. said clean-melting enclosure comprising:

1. an open front end;
2. a back wall, a plurality of side walls, a floor and a roof;
3. a plurality of telescopically-movable sections,
4. wherein at least some of the telescopically-movable sections of the plurality of telescopically-movable sections are slidably overimposed over at least one adjacent telescopically-movable section, thus creating a telescopically-expandable vertical surface;

iv. the dirt-melting gap is positioned below the clean-melting enclosure and is separated from the clean-melting enclosure by the floor;

v. the melting section further comprising a plurality of melting nozzles, said melting nozzles configured to release a pressurized stream of melting liquid, vi. wherein at least some of the plurality of melting nozzles are positioned in the open front end of the clean-melting enclosure and at least one of the plurality of melting nozzles is positioned below the floor, in the dirt-melting gap;

vii. wherein at least some of the plurality of melting nozzles are movably and adjustably positioned in the clean-melting section by being connected to at least one of the plurality of telescopically movable sections, and thus capable of movement in relation to other melting nozzles of the plurality of melting nozzles, by moving along with the movable sections; the device further comprising viii. a control panel, ix. a plurality of pipelines, x. a plurality of pumps, xi. at least one heating element, xii. a vacuum collector tank, xiii. a plurality of melting-liquid unloading tanks, said plurality of melting-liquid unloading tanks configured for sequential unloading of the melting liquid;

xiv. a plurality of valves, said plurality of valves comprising at least one distribution valve xv. the control panel comprises a power switch;

b. adjusting the plurality of telescopically-movable sections to position at least one of the plurality of melting nozzles above snow accumulations, c. filling the device with melting liquid, wherein the melting liquid is water;

d. activating the device by turning on the power switch on the control panel, e. moving the device forward through accumulations of snow;

f. collecting water from the device.

* * * * *